US010157580B2

(12) United States Patent
Chang et al.

(10) Patent No.: US 10,157,580 B2
(45) Date of Patent: Dec. 18, 2018

(54) ORGANIC LIGHT EMITTING DISPLAY HAVING DATA DRIVER SUPPLYING SENSING DATA VOLTAGE IN A SENSING MODE

(71) Applicant: LG Display Co., Ltd., Seoul (KR)

(72) Inventors: Min-Kyu Chang, Incheon (KR); Sung-Woo Park, Gyeongsangnam-do (KR); Shinji Takasugi, Gyeonggi-do (KR); Hyo-Jin Park, Jeollanam-do (KR); Jeong-Hyo Park, Gyeonggi-do (KR); Jeong-Pyo Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 3 days.

(21) Appl. No.: 14/969,212

(22) Filed: Dec. 15, 2015

(65) Prior Publication Data

US 2016/0189630 A1 Jun. 30, 2016

(30) Foreign Application Priority Data

Dec. 30, 2014 (KR) ..... 10-2014-0194262

(51) Int. Cl.

*G09G 3/30* (2006.01)
*G09G 3/3291* (2016.01)
*G09G 3/3233* (2016.01)

(52) U.S. Cl.

CPC ..... *G09G 3/3291* (2013.01); *G09G 3/3233* (2013.01); *G09G 2300/0819* (2013.01); (Continued)

(58) Field of Classification Search

CPC ..... G06F 3/03544; G06F 3/044
(Continued)

(56) References Cited

U.S. PATENT DOCUMENTS

2012/0162134 A1* 6/2012 Chen ..... G09G 3/3648 345/174
2013/0162617 A1* 6/2013 Yoon ..... G09G 3/3291 345/211
(Continued)

FOREIGN PATENT DOCUMENTS

CN 102279662 A 12/2011
CN 102646005 A 8/2012
(Continued)

OTHER PUBLICATIONS

The First Office Action dated Nov. 14, 2017 from the State Intellectual Property Office of the People's Republic of China in counterpart Chinese application No. 201510886149.9.

*Primary Examiner* — Roy P Rabindranath
(74) *Attorney, Agent, or Firm* — Morgan, Lewis & Bockius LLP

(57) ABSTRACT

An organic light emitting display includes a data driver supplying a sensing data voltage in a sensing mode to prevent degradation of image quality occurring due to a kick-back phenomenon. Each pixel of a display panel of the organic light emitting display has its driving characteristic sensed in the sensing mode. The data driver is configured to supply a high driving voltage, which is higher than the supplied sensing data voltage, and both voltages are successively applied to a data line of the display panel in the sensing mode.

11 Claims, 5 Drawing Sheets

(52) U.S. Cl.
CPC ..... *G09G 2320/0219* (2013.01); *G09G 2320/0295* (2013.01); *G09G 2320/043* (2013.01); *G09G 2320/0693* (2013.01); *G09G 2330/026* (2013.01); *G09G 2330/027* (2013.01)

(58) Field of Classification Search
USPC ..... 345/173–174, 76–82
See application file for complete search history.

(56) References Cited

U.S. PATENT DOCUMENTS

| | | | | |
|---|---|---|---|---|
| 2014/0111446 | A1* | 4/2014 | Lee | G06F 3/0416 345/173 |
| 2014/0168161 | A1* | 6/2014 | Sugita | G06F 3/044 345/174 |
| 2014/0347284 | A1* | 11/2014 | Lee, II | G06F 3/041 345/173 |
| 2015/0002421 | A1* | 1/2015 | Kim | G06F 3/041 345/173 |

FOREIGN PATENT DOCUMENTS

| | | | |
|---|---|---|---|
| CN | 103247664 | A | 8/2013 |
| CN | 103389824 | A | 11/2013 |
| CN | 103425367 | A | 12/2013 |
| CN | 104091562 | A | 10/2014 |
| CN | 203895093 | U | 10/2014 |

* cited by examiner

ORGANIC LIGHT EMITTING DISPLAY HAVING DATA DRIVER SUPPLYING SENSING DATA VOLTAGE IN A SENSING MODE

This application claims the benefit of Korean Patent Application No. 2014-0194262, filed on Dec. 30, 2014, which is hereby incorporated by reference as if fully set forth herein.

BACKGROUND OF THE INVENTION

Field of the Invention

The present invention relates to an organic light emitting display, and more particularly, to an organic light emitting display capable of preventing image quality degradation due to a kick-back phenomenon.

Discussion of the Related Art

An image display device that implements various types of information on a screen is a core technology in the era of information and communications, and has been developed into a thinner, lighter, mobile, and high-performance device. In this regard, an organic light emitting device that displays an image by controlling the amount of emitted light of an organic light emitting layer, etc. has drawn attention as a flat panel display that can overcome disadvantages of a heavy and large cathode-ray tube (CRT).

The organic light emitting device displays an image by arranging a plurality of pixels in a matrix form. Here, each pixel includes a light emitting element and a pixel driving circuit which independently drives the light emitting element and includes at least a switching thin film transistor (TFT), a storage capacitor, and a driving TFT.

A related art organic light emitting device has a problem of a luminance variation occurring due to deterioration of the light emitting element, a change of channel mobility, and/or a threshold voltage variation of the driving TFT included in each pixel even when the same data voltage is applied to each pixel. To solve this problem, the organic light emitting device uses an external compensation method in which a driving characteristic of each pixel is sensed in real time and data is compensated for in real time using information about the sensed characteristic.

In the external compensation method, the driving characteristic of each pixel is sensed in a blanking period between frame periods in which an image is implemented. In this instance, switching from each frame period to a blanking period incurs a kick-back phenomenon in which a gate voltage and a sensing voltage fluctuate due to parasitic capacitance between a data line and each of a scan line and a sensing line. The kick-back phenomenon varies according to a level of a data voltage supplied to each pixel during each frame period. Values of the threshold voltage and the mobility of the driving TFT sensed through the sensing line have errors due to a kick-back voltage that varies according to the level of the data voltage. Due to an error in the sensing voltage, a compensation value of the data voltage has an error. As a result, image quality is degraded.

SUMMARY

Accordingly, the present invention is directed to an organic light emitting display capable of preventing image quality degradation due to a kick-back phenomenon that substantially obviates one or more problems due to limitations and disadvantages of the related art.

An object of the present invention is to provide an organic light emitting display that successively supplies a high driving voltage, which is higher than a sensing data voltage, and the sensing data voltage to a data line of a display panel in a sensing mode in which a driving characteristic of a pixel is sensed.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. To achieve these and other advantages and in accordance with the purpose of the present invention, as embodied and broadly described, an organic light emitting display comprises a display panel including a plurality of pixels; and a data driver configured to supply a sensing data voltage to a data line of the display panel in a sensing mode in which a driving characteristic of each of the pixels is sensed, wherein the data driver successively supplies a high driving voltage higher than the sensing data voltage and the sensing data voltage in the sensing mode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Hereinafter, embodiments of the present invention will be described in detail with reference to the accompanying drawings.

Figure 1:
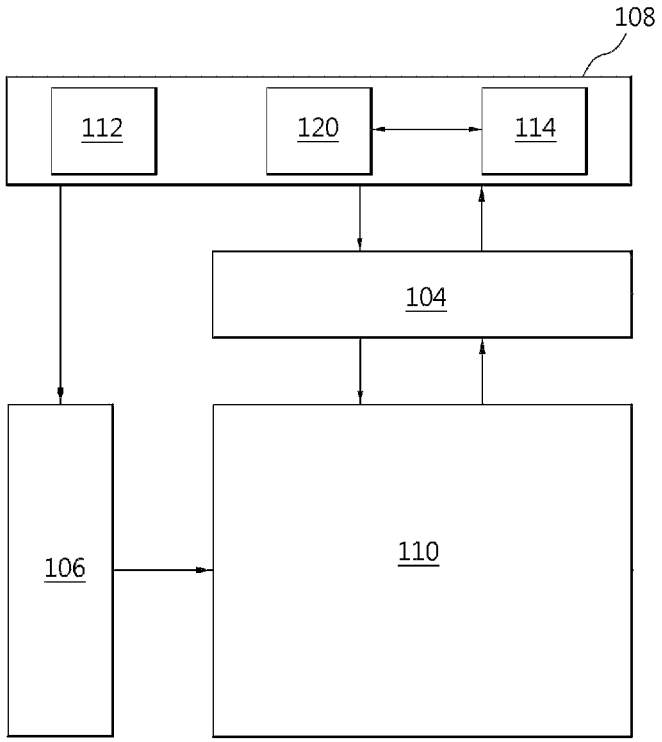
FIG. 1 is a block diagram illustrating an organic light emitting display according to an example embodiment of the present invention.

FIG. 1 illustrates an organic light emitting display according to an example embodiment of the present invention.

The organic light emitting display illustrated in FIG. 1 includes a data driver 104, a scan driver 106, a timing controller 108, and a light emitting display panel 110.

Figure 2:
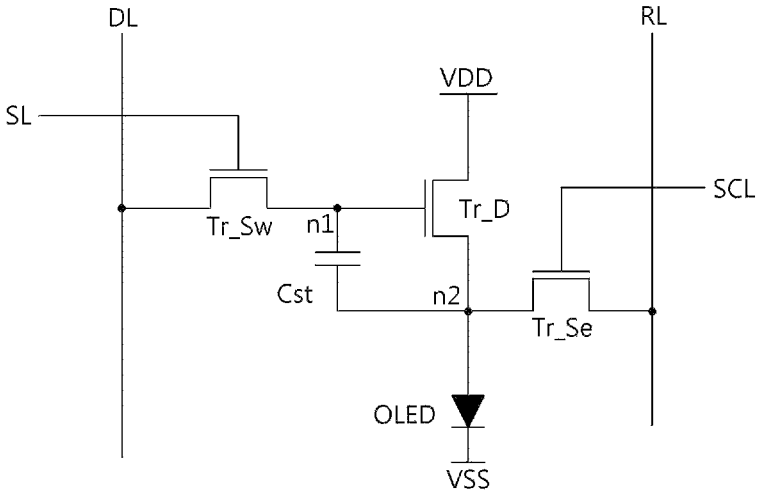
FIG. 2 is a circuit diagram illustrating each pixel of the organic light emitting display illustrated in FIG. 1.

The light emitting display panel 110 includes a plurality of pixels disposed in a matrix. As illustrated in FIG. 2, each pixel P includes a switching transistor Tr_Sw, a driving transistor Tr_D, a storage capacitor Cst, a sensing transistor Tr_Se, and an organic light emitting diode (OLED).

The OLED operates to emit light according to a driving current generated by the driving transistor Tr_D.

The switching transistor Tr_Sw performs a switching operation such that a data signal supplied through a data line DL is stored in the storage capacitor Cst as a data voltage in response to a first gate voltage supplied through a scan line (SL).

The driving transistor Tr_D operates such that a driving current flows between a high-potential line (VDD) and a low-potential line (VSS) according to the data voltage stored in the storage capacitor Cst.

The sensing transistor Tr_Se supplies a reference voltage Vref, which is supplied to a reference line RL, to a source electrode of the driving transistor Tr_D in response to a second gate voltage supplied through a sensing control line SCL. A threshold voltage, mobility, etc. of the driving transistor Tr_D are sensed through the sensing transistor Tr_Se and the reference line RL, and the data voltage is compensated for in proportion to a difference between a sensed value and a reference threshold voltage. The sensing transistor Tr_Se and the reference line RL may have various configurations, and thus a configuration of FIG. 2 is a specific example, and the present invention is not limited thereto.

The scan driver 106 supplies a first gate voltage in a high state or a low state to scan lines SL1 to SLm formed on the light emitting display panel 110 and supplies a second gate voltage in a high state or a low state to sensing control lines SCL1 to SCLm in response to a gate control signal GCS from the timing controller 108.

The data driver 104 converts digital pixel data into an analog data voltage using a gamma voltage and a data control signal DCS from the timing controller 108 in a display mode and a sensing mode, and supplies the converted analog data voltage to the data line DL. In particular, the data driver 104 successively supplies a high driving voltage Vhigh and a sensing data voltage Vsdata to the data line DL in the sensing mode such that the same level of kick-back is incurred in each pixel in the sensing mode. Here, the high driving voltage Vhigh is higher than the sensing data voltage Vsdata. The high driving voltage Vhigh may be newly generated in a power supply (not illustrated). Alternatively, a voltage which is previously used when the organic light emitting display is driven may be used as the high driving voltage Vhigh to reduce costs.

In addition, the data driver 104 converts a voltage (or current) sensed through the sensing transistor (Tr_Se) and the reference line RL in the sensing mode into a digital sensing value, and supplies the converted value to the timing controller 108.

The timing controller 108 includes a control signal generator 112, a data processor 120, and a memory 114.

The control signal generator 112 generates the gate control signal GCS and the data control signal DCS which control driving timings of the scan driver 106 and the data driver 104 based on a synchronization signal input from the outside. The generated gate control signal GCS is supplied to the scan driver 106, and the generated data control signal DCS is supplied to the data driver 104.

The data processor 120 compensates for image data input from the outside using compensation information of the memory 114, and outputs the compensated data to the data driver 104. The data processor 120 processes sensing information of each pixel sensed through the data driver 104 according to a predetermined operation to update the compensation information of the memory 114.

The memory 114 stores compensation information configured according to a characteristic of each pixel. The compensation information includes a threshold voltage compensation value for compensating for a threshold voltage of a driving transistor of each sub-pixel and a mobility compensation value for compensating for mobility of the driving transistor.

The compensation information is configured in advance based on a sensing value obtained by sensing a characteristic (threshold voltage and/or mobility) of each pixel before shipping products. After shipping products, the compensation information stored in the memory 114 is updated when the characteristic of each pixel is sensed again in the sensing mode in every desired driving time. The compensation information stored in the memory 114 may be updated when the sensing mode is executed in every desired driving time including at least one of a booting time while power is turned ON, an ending time while power is turned OFF, a blanking time of each frame, etc.

Figure 3:
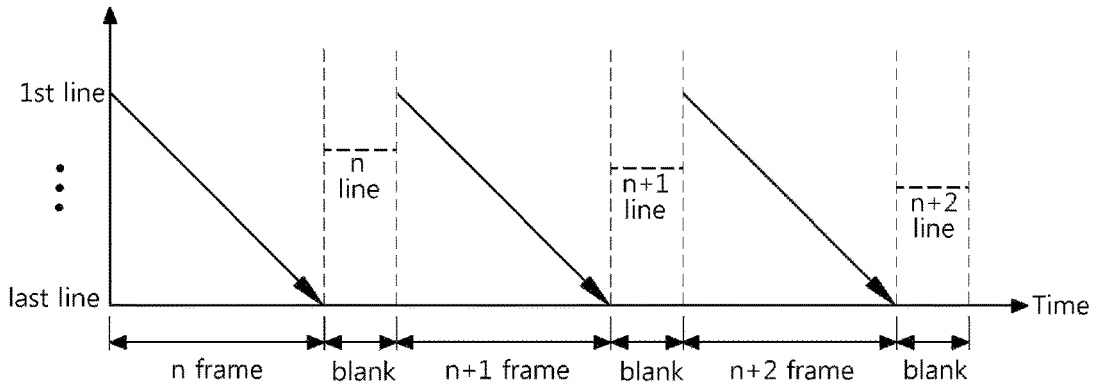
FIG. 3 is a diagram for description of a real-time sensing period in the organic light emitting display illustrated in FIG. 2.

FIG. 3 illustrates real-time sensing of the organic light emitting display according to the present invention.

As illustrated in FIG. 3, a blanking period is allocated between a previous frame period and a current frame period. In each frame period, image data is line-sequentially written to each pixel. In each blanking period, the compensation information of the memory 114 is updated by sensing characteristics of pixels on one horizontal line.

For example, characteristics of pixels on an n-th horizontal line are sensed in a blanking period of an n-th frame to update compensation values of the pixels in the memory 114, characteristics of pixels on an (n+1)th horizontal line are sensed in a blanking period of an (n+1)th frame to update compensation values of the pixels in the memory 114, and characteristics of pixels on an (n+2)th horizontal line are sensed in a blanking period of an (n+2)th frame to update compensation values of the pixels in the memory 114.

Meanwhile, in each blanking period, sub-pixels on a corresponding horizontal line may be sensed separately for each color. For example, when a display panel has N horizontal lines, R sub-pixels may be sensed for each horizontal line in every blanking period of N frames, and W sub-pixels may be sensed for each horizontal line in every blanking period of N subsequent frames. Thereafter, B sub-pixels may be sensed, and then G sub-pixels may be sensed in a similar manner.

Figure 4:
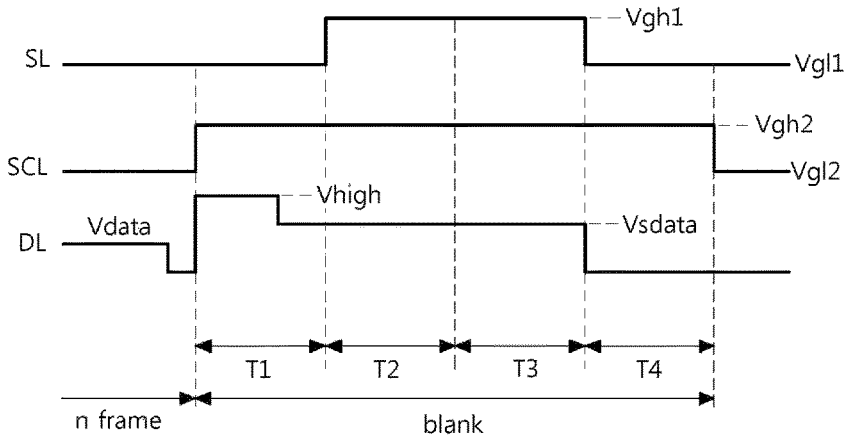
FIG. 4 is a diagram illustrating waveforms for description of a first example of a blanking period illustrated in FIG. 3.

FIG. 4 illustrates waveforms for specifically describing the blanking period illustrated in FIG. 3.

As illustrated in FIG. 4, a blanking period BT includes a kick-back induction period T1, an initialization period T2, a charging period T3, and a sensing period T4 in order. The kick-back induction period T1, the initialization period T2, the charging period T3, and the sensing period T4 will be described in detail in connection with a pixel driving circuit illustrated in FIG. 2.

First, in the kick-back induction period T1, a first gate voltage Vgl1 in a low state is supplied to the scan line SL, a second gate voltage Vgh2 in a high state is supplied to the sensing control line SCL, a high driving voltage Vhigh and a sensing data voltage Vsdata are successively supplied to the data line DL, and a pre-charging voltage Vpre is supplied to the reference line RL. Here, the high driving voltage Vhigh and the sensing data voltage Vsdata are supplied to the data line DL before the first gate voltage Vgl1 in a low state, which is supplied in the initialization period T2, is supplied.

When a voltage supplied to the data line DL is switched from the high driving voltage Vhigh to the sensing data voltage Vsdata, the first gate voltage Vgl1 in the low state supplied to the scan line SL decreases by a voltage ΔVp (kick-back voltage) as in Equation 1 by a parasitic capacitor Cp, and thus a kick-back phenomenon occurs.

$$\Delta Vp \propto (Vhigh - Vsdata) \quad \text{[Equation 1]}$$

Therefore, the same high driving voltage Vhigh and the same sensing data voltage Vsdata are successively supplied to the data line DL of every pixel sensed during a blanking period of each frame period, and thus all pixels have the same difference between the high driving voltage Vhigh and the sensing data voltage Vsdata. As a result, the same kick-back voltage is generated during a blanking period in each pixel irrespective of the data voltage Vdata supplied in each frame period, and thus all pixels have the same error in sensing values. In this way, abnormal image quality may be prevented.

In the initialization period T2, a first gate voltage Vgh1 in a high state is supplied to the scan line SL, a second gate voltage Vgh2 in a high state is supplied to the sensing control line SCL, a sensing data voltage Vsdata corresponding to a level of a voltage configured to sense a threshold voltage and mobility of the driving transistor Tr_D is supplied to the data line DL, and a pre-charging voltage Vpre is supplied to the reference line RL.

The data voltage Vdata from the data line DL is supplied to a first node n1, that is, a gate terminal G of the driving transistor Tr_D through the switching transistor Tr_Sw which is turned ON in response to the first gate voltage Vgh1 in the high state. In addition, the pre-charging voltage Vpre from the reference line RL is supplied to a second node n2, that is, a source of the driving transistor Tr_D through the sensing transistor Tr_Se which is turned ON in response to the second gate voltage Vgh2 in the high state.

In this way, a source electrode of the driving transistor Tr_D and the reference line RL are initialized to the pre-charging voltage Vpre during the initialization period T2. In this instance, a difference voltage between the data voltage Vdata and the pre-charging voltage Vpre is stored in the storage capacitor Cst.

Subsequently, in the charging period T3, a first gate voltage supplied to the switching transistor Tr_Sw through the scan line SL is maintained in a high state (Vgh1), and a second gate voltage supplied to the sensing transistor Tr_Se through the sensing control line SCL is maintained in a high state (Vgh2).

The sensing data voltage Vsdata is supplied to the first node n1, that is, a gate of the driving transistor Tr_D through the switching transistor Tr_Sw which is in an ON state in response to the first gate voltage Vgh1 in the high state. In this instance, the reference line RL is in a floating state. In this way, the reference line RL in the floating state is charged with a difference voltage between a data voltage supplied to a gate electrode of the driving transistor Tr_D and the threshold voltage of the driving transistor Tr_D.

In the sensing period T4, a first gate voltage supplied to the switching transistor Tr_Sw through the scan line SL is maintained in a high state (Vgh1), a second gate voltage Vgl2 in a low state is supplied to the sensing control line SCL, and the reference line RL is connected to the data driver 104. In this way, the data driver 104 extracts the threshold voltage and mobility of the driving transistor Tr_D by sensing a voltage of the reference line RL, converts the extracted threshold voltage and mobility of the driving transistor Tr_D into digital sensing values, and supplies the converted values to the timing controller 108.

Figure 5:
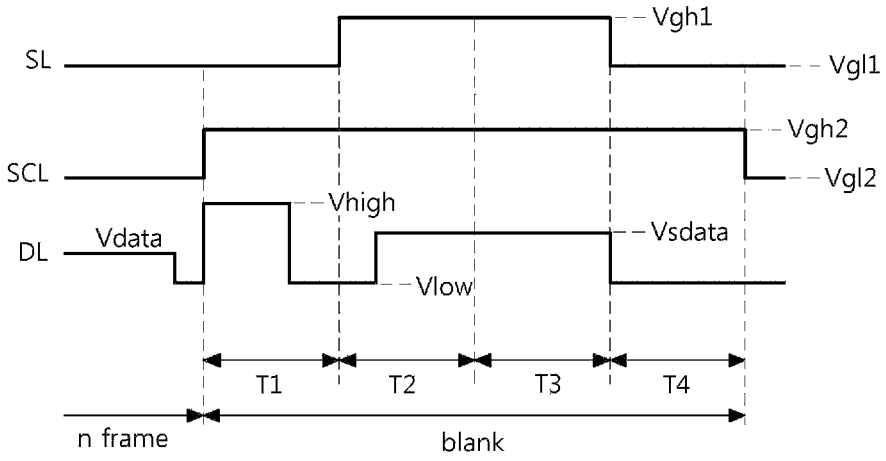
FIG. 5 is a diagram illustrating waveforms for description of a second example of the blanking period illustrated in FIG. 3.

FIG. 5 illustrates waveforms corresponding to another example of driving waveforms supplied in the blanking period illustrated in FIG. 4. The blanking period illustrated in FIG. 5 has the same components as the blanking period illustrated in FIG. 4 except that a low driving voltage Vlow is additionally supplied in a kick-back induction period T1 and an initialization period T2, and thus detailed description thereof will be omitted.

In the kick-back induction period T1, a first gate voltage Vgl1 in a low state is supplied to the scan line SL, a second gate voltage Vgh2 in a high state is supplied to the sensing control line SCL, a high driving voltage Vhigh and the low driving voltage Vlow are successively supplied to the data line DL, and a pre-charging voltage Vpre is supplied to the reference line RL.

Here, when the voltage supplied to the data line DL drops from the high driving voltage Vhigh to the low driving voltage Vlow, the kick-back phenomenon occurs. In the kick-back phenomenon, the first gate voltage Vgl1 in the low state supplied to the scan line SL decreases by a voltage ΔVp (kick-back voltage) as in Equation 2 by the parasitic capacitor Cp.

$$\Delta Vp \propto (Vhigh - Vlow) \quad \text{[Equation 2]}$$

Therefore, the same high driving voltage Vhigh and the same low driving voltage Vlow are successively supplied to the data line DL of every pixel sensed during a blanking period of each frame period, and thus all pixels have the same difference between the high driving voltage Vhigh and the low driving voltage Vlow. As a result, the same kick-back voltage is generated in each pixel irrespective of the data voltage Vdata supplied in each frame period, and thus all pixels have the same error in sensing values. In this way, abnormal image quality may be prevented.

In the initialization period T2, a first gate voltage Vgh1 in a high state is supplied to the scan line SL, a second gate voltage Vgh2 in a high state is supplied to the sensing control line SCL, a low driving voltage Vlow and a sensing data voltage Vdata_sen are successively supplied to the data line DL, and a pre-charging voltage Vpre is supplied to the reference line RL. In this instance, a level of the low driving voltage Vlow is set such that, in response to the first gate voltage supplied to the scan line SL rising from a low voltage to a high voltage, the data voltage supplied to the data line DL rises. In other words, the level is set such that the data voltage supplied to the data line rises from the low driving voltage Vlow to a sensing data voltage Vsdata. Therefore, a period at which the first gate voltage Vgh1 in the high state is supplied partially overlaps a period at which the low driving voltage Vlow is supplied.

In this way, when the voltage supplied to the data line DL rises from the low driving voltage Vlow to the sensing data voltage Vsdata, the first gate voltage Vgh1 in the high state supplied to the scan line SL increases by a voltage ΔVp as in Equation 3 by the parasitic capacitor.

$$\Delta Vp \propto (Vsdata - Vlow) \quad \text{[Equation 3]}$$

Therefore, the same low driving voltage Vlow and the same sensing data voltage Vsdata are supplied to the data line DL of every pixel sensed during a blanking period of each frame period, and thus all pixels have the same difference between the low driving voltage Vlow and the sensing data voltage Vsdata. As a result, the same second kick-back voltage ΔVp2 is generated in each pixel irrespective of the data voltage Vdata supplied in the frame period, and thus all pixels have the same error in sensing values. In this way, abnormal image quality may be prevented.

Meanwhile, the low driving voltage Vlow illustrated in FIG. 5 is lower than the sensing data voltage Vsdata. The low driving voltage Vlow may be newly generated in a power supply (not illustrated). Alternatively, a voltage which is previously used in the organic light emitting display may be used as the low driving voltage Vlow to reduce costs.

Figure 6A:
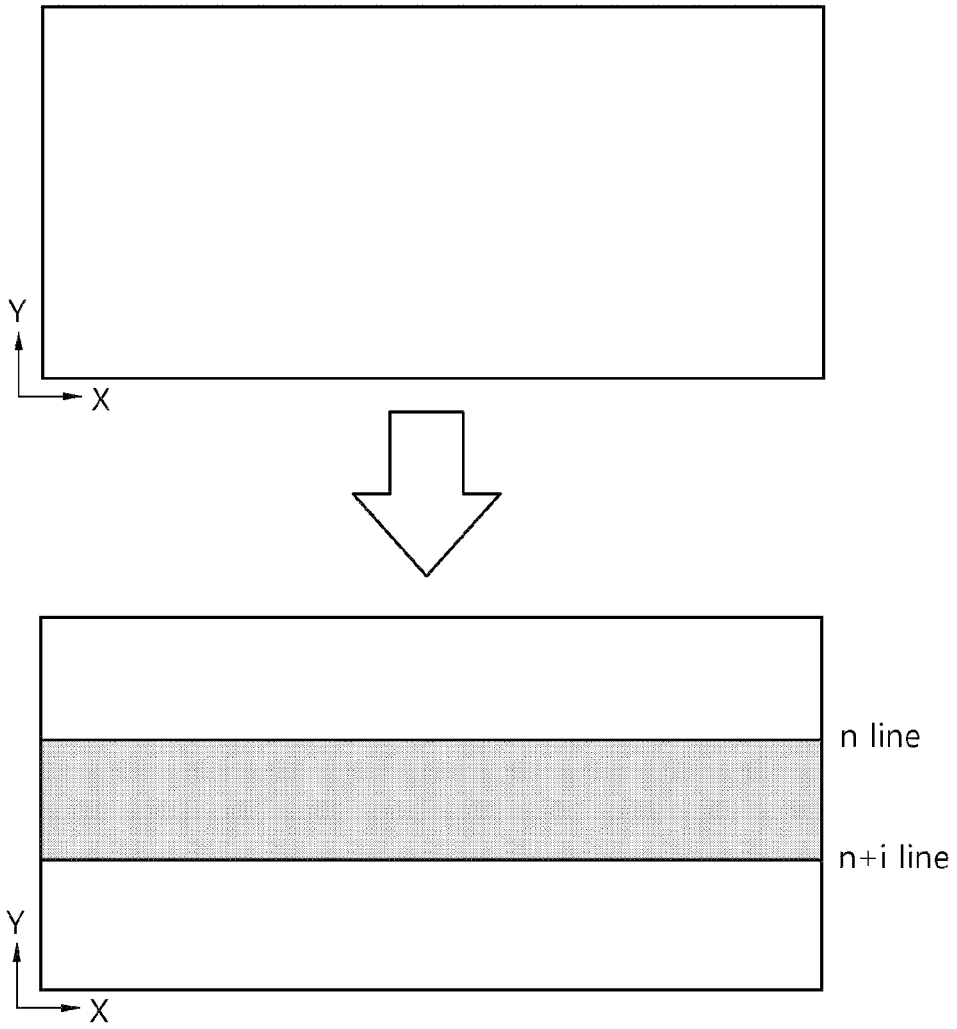
FIG. 6A is a diagram for description of an image implemented to measure an error in a sensing value of the organic light emitting display according to the present invention.
Figure 6B:
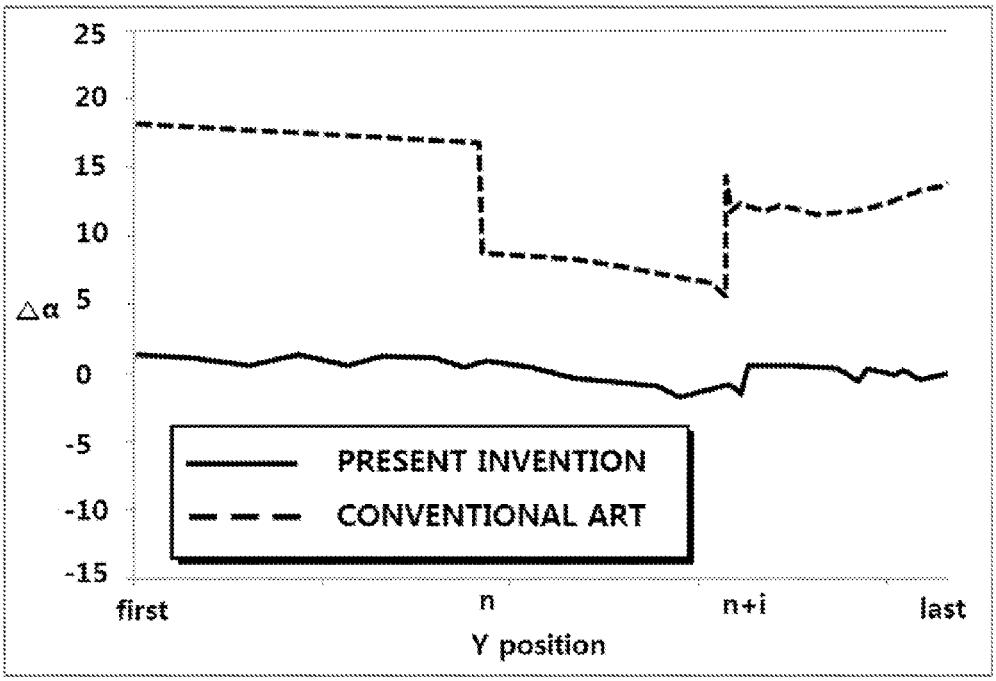
FIG. 6B is a graph illustrating a deviation between sensing values measured using first and second test images illustrated in FIG. 6A.

FIG. 6A illustrates an image implemented to measure errors in sensing values of the related art organic light emitting display and the organic light emitting display according to the present invention, and FIG. 6B illustrates a deviation in sensing values measured using first and second test images illustrated in FIG. 6A.

As illustrated in FIG. 6A, after a first block or while a test image is implemented on a light emitting display panel, a first sensing value is extracted by sensing a characteristic of a driving transistor. In addition, after a second test image is implemented between an n-th horizontal line and an (n+1)th horizontal line (here, n and i are natural numbers) of the light emitting display panel, a second sensing value is extracted by sensing a characteristic of the driving transistor. Subsequently, a deviation Δα between the first sensing value and the second sensing value is calculated. As a result, as illustrated in FIG. 6B, while a sensing deviation is great between an area, in which the second test image is implemented, and the other area in the related art organic light emitting display, the sensing values are uniform in the present invention irrespective of positions. In other words, it can be understood that, in the related art organic light emitting display, errors in sensing values are great in respective positions, and thus abnormal image quality is generated. On the other hand, in the present invention, errors in sensing values are similar to one another in respective positions, and thus abnormal image quality is prevented.

Meanwhile, in the present invention, description has been given on the assumption that the high driving voltage Vhigh and the low driving voltage Vlow are supplied to the data line DL through the data driver 104. However, the high driving voltage Vhigh and the low driving voltage Vlow may be supplied to the data line DL through the data driver 104 and another separate driver.

An organic light emitting display according to the present invention successively supplies the same high driving voltage and the same sensing data voltage (or low driving voltage) which is lower than the high driving voltage to data lines of all pixels sensed in a blanking period. Therefore, the same kick-back voltage is generated in each pixel irrespective of a data voltage supplied in each frame period, and thus all pixels have the same error in sensing values. In this way, abnormal image quality may be prevented.

It will be apparent to those skilled in the art that various modifications and variations can be made in the organic light emitting display of the present invention without departing from the spirit or scope of the invention. Thus, it is intended that the present invention cover the modifications and variations of this invention provided they come within the scope of the appended claims and their equivalents.

What is claimed is:

1. An organic light emitting display, comprising:

a display panel including a plurality of pixels;

a scan driver configured to drive a scan line of the display panel; and a data driver configured to supply a high driving voltage and a sensing data voltage, which are successively applied to a data line of the display panel in a sensing mode in which a driving characteristic of a driving transistor included in a pixel of the plurality of pixels is sensed to update a compensation value of the pixel, wherein the high driving voltage is higher than the sensing data voltage; and wherein the high driving voltage is supplied to the data line before a gate voltage in a high state is supplied to the scan line in the sensing mode.

2. The organic light emitting display according to claim 1, wherein the driving characteristic of the driving transistor included in the pixel is sensed in a blanking period between frame periods in which images are displayed, and wherein the same high driving voltage and the same sensing data voltage are supplied to data lines of all pixels sensed in a blanking period of each frame.

3. The organic light emitting display according to claim 1, wherein the high driving voltage is supplied to the data line in the sensing mode from a source of another driving voltage that is used by the organic light emitting display and is higher than the sensing data voltage.

4. The organic light emitting display according to claim 1, wherein:

the data driver is configured to supply the high driving voltage at a start of the sensing mode; and the data driver is configured, in the sensing mode, to supply the high driving voltage and the sensing data voltage to the data line before the gate voltage in the high state is supplied to the scan line.

5. The organic light emitting display device according to claim 4, further comprising:

the scan driver configured to drive a sensing control line of the display panel, wherein the scan driver is configured to supply a voltage in a high state to the sensing control line at the start of the sensing mode.

6. An organic light emitting display, comprising:

a display panel including a plurality of pixels; and a data driver configured to supply a sensing data voltage to a data line of the display panel in a sensing mode in which a driving characteristic of a driving transistor included in a pixel of the plurality of pixels is sensed to update a compensation value of the pixel, and to supply a high driving voltage higher than the sensing data voltage and a low voltage lower than the sensing data voltage, wherein the high driving voltage, the low driving voltage, and the sensing data voltage are successively applied to the data line of the display panel in the sensing mode; and wherein the high driving voltage is supplied to the data line before a gate voltage in a high state is supplied to the scan line in the sensing mode.

7. The organic light emitting display according to claim 6, wherein the low driving voltage is supplied during a period that overlaps a period during which the gate voltage supplied to the scan line transitions to the high state.

8. The organic light emitting display according to claim 5, wherein:

the data driver is configured to supply the high driving voltage at a start of the sensing mode; and the data driver is configured, in the sensing mode, to supply the high driving voltage and the low voltage to the data line before the gate voltage in the high state is supplied to the scan line.

9. The organic light emitting display device according to claim 8, further comprising:

a scan driver configured to drive a sensing control line of the display panel, wherein the scan driver is configured to supply a voltage in a high state to the sensing control line at the start of the sensing mode.

10. The organic light emitting display according to claim 6, wherein the same high driving voltage and the same low driving voltage are supplied to the data lines of all the pixels sensed in a blanking period of each frame in the sensing mode.

11. The organic light emitting display according to claim 6, wherein the low driving voltage immediately follows the high driving voltage.

* * * * *